US006854521B2

(12) United States Patent
Echols et al.

(10) Patent No.: US 6,854,521 B2
(45) Date of Patent: Feb. 15, 2005

(54) SYSTEM AND METHOD FOR CREATING A FLUID SEAL BETWEEN PRODUCTION TUBING AND WELL CASING

(75) Inventors: Ralph H. Echols, Dallas, TX (US); Tommie A. Freeman, Flower Mound, TX (US); John C. Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 63 days.

(21) Appl. No.: 10/101,683

(22) Filed: Mar. 19, 2002

(65) Prior Publication Data

US 2003/0178204 A1 Sep. 25, 2003

(51) Int. Cl.[7] ..... E21B 23/06; E21B 33/128; E21B 33/1295; E21B 29/12

(52) U.S. Cl. ..... 166/387; 166/120; 166/123; 166/212; 166/214; 166/277

(58) Field of Search ..... 166/277, 278, 166/281, 285, 308, 373, 374, 381, 386, 387, 51, 118, 172, 120, 123, 225, 121, 131, 187, 199, 206, 207, 212, 216, 217, 242.3

(56) References Cited

U.S. PATENT DOCUMENTS

| | | | | |
|---|---|---|---|---|
| 1,981,525 | A | * 11/1934 | Price | 166/381 |
| 2,519,116 | A | * 8/1950 | Crake | 166/63 |
| 5,348,095 | A | 9/1994 | Worrall et al. | 166/380 |
| 5,366,012 | A | 11/1994 | Lohbeck | 166/277 |
| 5,562,000 | A | 10/1996 | Shultz, Sr. | 72/393 |
| 5,667,011 | A | 9/1997 | Gill et al. | 166/295 |
| 5,901,789 | A | 5/1999 | Donnelly et al. | 166/381 |
| 6,012,523 | A | 1/2000 | Campbell et al. | 166/277 |
| 6,021,850 | A | 2/2000 | Wood et al. | 166/380 |
| 6,029,748 | A | 2/2000 | Forsyth et al. | 166/380 |
| 6,070,671 | A | 6/2000 | Cumming et al. | 166/381 |
| 6,098,717 | A | * 8/2000 | Bailey et al. | 166/382 |
| 6,253,850 | B1 | 7/2001 | Nazzai et al. | 166/277 |
| 6,315,040 | B1 | 11/2001 | Donnelly | 166/207 |
| 6,510,896 | B2 | * 1/2003 | Bode et al. | 166/276 |
| 6,527,049 | B2 | * 3/2003 | Metcalfe et al. | 166/277 |
| 6,543,552 | B1 | * 4/2003 | Metcalfe et al. | 175/57 |
| 6,550,539 | B2 | * 4/2003 | Maguire et al. | 166/380 |
| 6,591,905 | B2 | * 7/2003 | Coon | 166/117.6 |
| 2002/0139540 | A1 | * 10/2002 | Lauritzen | 166/387 |
| 2002/0145281 | A1 | * 10/2002 | Metcalfe et al. | 285/206 |
| 2002/0162664 | A1 | * 11/2002 | Bode et al. | 166/380 |
| 2003/0024711 | A1 | * 2/2003 | Simpson et al. | 166/384 |
| 2003/0037931 | A1 | * 2/2003 | Coon | 166/387 |
| 2003/0042022 | A1 | * 3/2003 | Lauritzen et al. | 166/277 |
| 2003/0042028 | A1 | * 3/2003 | Lauritzen et al. | 166/384 |
| 2003/0047320 | A1 | * 3/2003 | Badrak et al. | 166/380 |

(List continued on next page.)

FOREIGN PATENT DOCUMENTS

| | | | |
|---|---|---|---|
| GB | 2 336 383 A | 4/1999 | E21B/43/08 |
| GB | 2 344 606 A | 11/1999 | E21B/33/14 |

(List continued on next page.)

*Primary Examiner*—David Bagnell
*Assistant Examiner*—Jennifer Gay
(74) *Attorney, Agent, or Firm*—Lawrence R. Youst

(57) ABSTRACT

A well completion system for creating a seal between a production tubing (30) and a well casing (34) positioned within a wellbore (32) comprises a production packer (46) that includes a section of the production tubing (30) and at least one seal element (60). The production tubing (30) is then positioned within the well casing (34) that lines the wellbore (32). An expander member (56) that is positioned within the production tubing (30) then travels longitudinally through the production packer (46) to expand the section of the production tubing (30) downhole that includes the seal element (60). This expansion creates a sealing and gripping relationship between the production tubing (30) and the well casing (34).

16 Claims, 11 Drawing Sheets

U.S. PATENT DOCUMENTS

| | | | | |
|---|---|---|---|---|
| 2003/0047322 | A1 * | 3/2003 | Maguire et al. | 166/380 |
| 2003/0047323 | A1 * | 3/2003 | Jackson et al. | 166/380 |
| 2003/0051885 | A1 * | 3/2003 | Simpson et al. | 166/384 |
| 2003/0106697 | A1 * | 6/2003 | Bode et al. | 166/381 |
| 2003/0116328 | A1 * | 6/2003 | Doane et al. | 166/387 |

FOREIGN PATENT DOCUMENTS

| | | | |
|---|---|---|---|
| GB | 2 348 223 A | 3/2000 | E21B/7/20 |
| WO | WO 99/23354 | 5/1999 | E21B/43/10 |
| WO | WO 99/25951 | 5/1999 | E21B/43/10 |
| WO | WO 00/26500 | 5/2000 | E21B/19/22 |
| WO | WO 00/26501 | 5/2000 | E21B/23/01 |
| WO | WO 00/26502 | 5/2000 | E21B/29/10 |
| WO | WO 00/37771 | 6/2000 | E21B/43/10 |
| WO | WO 00/39432 | 7/2000 | E21B/43/10 |
| WO | WO 01/18353 A1 | 3/2001 | E21B/43/10 |
| WO | WO 01/18354 A1 | 3/2001 | E21B/43/10 |
| WO | WO 01/18355 A1 | 3/2001 | E21B/43/10 |
| WO | WO 01/83943 A1 | 11/2001 | E21B/43/10 |

* cited by examiner

SYSTEM AND METHOD FOR CREATING A FLUID SEAL BETWEEN PRODUCTION TUBING AND WELL CASING

TECHNICAL FIELD OF THE INVENTION

This invention relates, in general, to completing a well that traverses a hydrocarbon bearing subterranean formation and, in particular, to a system and method for creating a fluid seal between production tubing and well casing by expanding a section of the production tubing having seal elements positioned therearound.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation. Conventionally, each section of the casing string is cemented within the wellbore before the next section of the wellbore is drilled. Accordingly, each subsequent section of the wellbore must have a diameter that is less than the previous section.

For example, a first section of the wellbore may receive a conductor casing string having a 20-inch diameter. The next several sections of the wellbore may receive intermediate casing strings having 16-inch, 13⅜-inch and 9⅝-inch diameters, respectively. The final sections of the wellbore may receive production casing strings having 7-inch and 4½-inch diameters, respectively. Each of the casing strings may be hung from a casing head near the surface. Alternatively, some of the casing strings may be in the form of liner strings that extend from near the setting depth of previous section of casing. In this case, the liner string will be suspended from the previous section of casing on a liner hanger.

Once this well construction process is finished, the completion process may begin. The completion process comprises numerous steps including creating hydraulic openings or perforations through the production casing string, the cement and a short distance into the desired formation or formations so that production fluids may enter the interior of the wellbore. In addition, the completion process may involve formation stimulation to enhance production, gravel packing to prevent sand production and the like. The completion process also includes installing a production tubing string within the well that extends from the surface to the production interval or intervals. Unlike the casing strings that form a part of the wellbore itself, the production tubing string is used to produce the well by providing the conduit for formation fluids to travel from the formation depth to the surface.

Typically, a production packer is run into the well on the production tubing string. The purpose of the packer is to support production tubing and other completion equipment, such as a screen adjacent to a producing formation, and to seal the annulus between the outside of the production tubing and the inside of the well casing to block movement of fluids through the annulus past the packer location.

Conventionally, the packer is provided with anchor slips having opposed camming surfaces which cooperate with complementary opposed wedging surfaces, whereby the anchor slips are radially extendible into gripping engagement against the interior of the well casing in response to relative axial movement of the wedging surfaces.

The packer also carries annular seal elements which are expandable radially into sealing engagement against the interior of the well casing in response to axial compression forces. The longitudinal movement of the packer components required to set the anchor slips and the sealing elements may be produced either hydraulically or mechanically.

After the packer has been set and sealed against the well casing, this sealing engagement will typically remain even upon removal of the hydraulic or mechanical setting force. In fact, it is essential that the packer remain locked in its set and sealed configuration such that it can withstand hydraulic pressures applied externally or internally from the formation and/or manipulation of the production tubing string and service tools without unsetting or interrupting the seal.

It has been found, however, that to provide the required sealing and gripping capabilities, conventional packers have become quite complex. In addition, it has been found that due to the complexity of conventional packers, the cost of conventional packers is quite high. Further, it has been found that even with the complexity of conventional packers, some conventional packers fail to provide the necessary sealing and/or gripping capability after installation.

A need has therefore arisen for a system and method for creating a fluid seal between production tubing and well casing that does not require a complex conventional packer. A need has also arisen for such a system and method that are capable of reducing the cost typically associated with manufacturing a conventional packer. Further, a need has arisen for such a system and method that provide for improved sealing and gripping capabilities upon installation.

SUMMARY OF THE INVENTION

The present invention disclosed herein comprises a system and method for creating a fluid seal between production tubing and well casing that does not require a complex conventional packer. The system and method of the present invention are capable of reducing the cost typically associated with manufacturing a conventional packer. In addition, the system and method of the present invention provide for improved sealing and gripping capabilities upon installation.

The well completion system for creating a seal between a production tubing and a well casing of the present invention comprises a production packer including a section of the production tubing and at least one seal element and an expander member positioned within the production tubing that travels longitudinally through the production packer to expand the section of the production tubing downhole, thereby creating the seal between the production tubing and the well casing. The expander member may travel longitudinally within the production packer from an uphole location to a downhole location or from a downhole location to an uphole location.

The expander member may be urged to travel longitudinally within the production packer by pressurizing at least a portion of the production tubing. Alternatively, coiled tubing may be coupled to the expander member. In this case, the expander member may be urged to travel longitudinally within the production packer by pressurizing the coiled tubing and at least a portion of the production tubing, by pulling the coiled tubing or both. Prior to pressurizing the portion of the production tubing a plug may be set within the production tubing to seal the pressure within the production tubing that acts on the expander member. Alternatively, the expander member may be urged to travel longitudinally within the production packer by pushing on the coiled tubing to compress the expander member then pressurizing the coiled tubing and an interior section of the expander member to urge the expander member to travel longitudinally within the production packer.

Following the expansion of the production packer and during the same trip downhole, a treatment fluid may be pumped downhole and through a cross-over assembly operably associated with the expander member such that the treatment fluid is delivered into an annulus between the production tubing and the well casing downhole of the production packer. The treatment preformed may be a fracture treatment, a gravel pack, a frac pack or the like. Following the treatment process, the expander member may be retrieved to the surface by decoupling a work string, carrying the expander member and the cross-over assembly, from the production tubing that is now fixed within the casing.

Broadly stated, the method of the present invention involves lining the wellbore with the well casing, disposing a production packer including a section of the production tubing and at least one seal element within the well casing and setting the production packer downhole by radially expanding the section of the production tubing, thereby creating the seal between the production tubing and the well casing.

The method of the present invention may also involve lining the wellbore with the well casing, positioning an expander member and a plug within the production tubing, disposing a production packer including a section of the production tubing and at least one seal element within the well casing, coupling a coiled tubing to the expander member, installing the plug within the production tubing, pressurizing the coiled tubing and at least a portion of the production tubing between the plug and the expander member, urging the expander member to travel longitudinally within the production packer, creating the seal between the production tubing and the well casing, retrieving the coiled tubing and the expander member uphole and retrieving the plug uphole.

Likewise, the method of the present invention may involve disposing a production packer including a section of a production tubing and at least one seal element within a well casing, setting the production packer downhole by radially expanding the section of the production tubing to create a seal between the production tubing and the well casing and pumping a treatment fluid through a cross-over assembly into an annulus between the production tubing and the well casing downhole of the production packer.

Once an expandable production packer of the present invention is installed, it may become necessary to remove the expandable production packer of the present invention from its sealing relationship with the well casing. One method for releasing an expandable production packer of the present invention involves positioning a release member within the expandable production packer such that first and second end sections of the release member are on opposite sides of the seal element of the expandable production packer and operating the release member such that the diameter of the seal element is reduced, thereby releasing the seal element from contact with the well casing.

This reduction may be achieved by elongating the expandable production packer, by generating a radially inwardly acting collapse force due to a differential pressure between the interior and the exterior of the expandable production packer or both. In those embodiments wherein the collapse force is utilized, this operation may be enhanced by weakening the expandable production packer behind the seal element. This weakening process may be achieved chemically, mechanically, thermally, explosively or the like.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
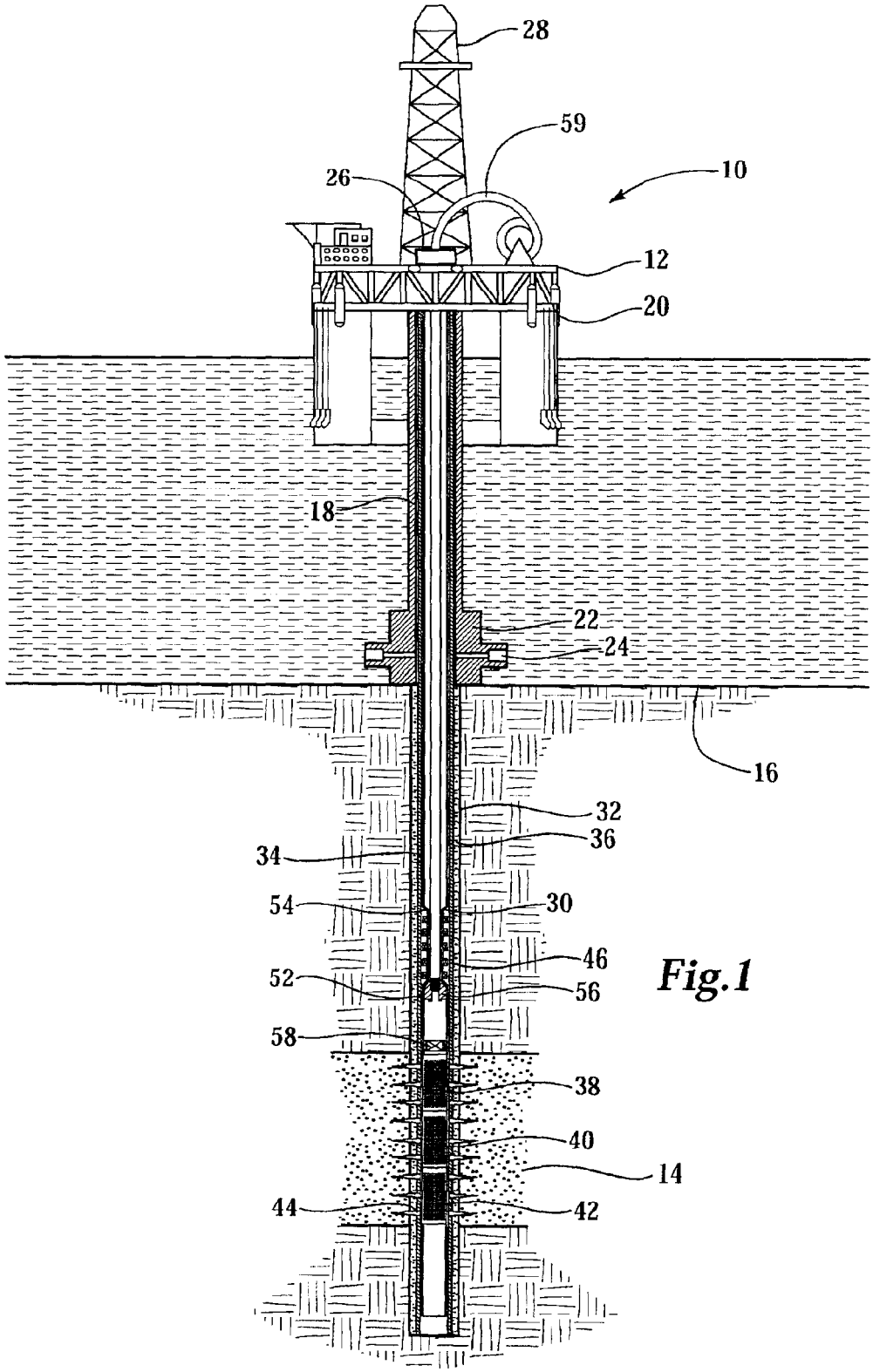
FIG. 1 is a schematic illustration of an offshore oil and gas platform installing an expandable production packer according to the present invention.

Referring initially to FIG. 1, an expandable production packer of the present invention is being installed from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as production tubing string 30.

A wellbore 32 extends through the various earth strata including formation 14. A casing 34 is cemented within wellbore 32 by cement 36. Production tubing string 30 is coupled on its lower end to various tools including sand control screen assemblies 38, 40, 42 positioned adjacent to formation 14 and perforations 44 below expandable production packer 46.

As explained in greater detail below, to provide a seal between casing 34 and production tubing 30, expandable production packer 46 may be expanded. Accordingly, production tubing 30 includes, above and below expandable production packer 46 of the present invention, a launcher 52 and a catcher 54 between which an expander member 56 longitudinally travels to plastically deform expandable production packer 46. In the illustrated embodiment, this is achieved by pressurizing production tubing string 30 between a plug 58 and the lower end of expander member 56 by pumping fluid down through a work string such as a jointed tubing string or, as illustrated, a coiled tubing string 59 that is coupled to expander member 56.

Referring now to FIGS. 2–5, therein are depicted more detailed views of one method for creating a fluid seal between production tubing 30 and well casing 34 with an expandable production packer 46. Expandable production packer 46 includes a plurality of seal elements 60A–60E that are positioned around an expandable section of tubing string 30. Once the expansion process is performed, seal elements 60A–60E are placed in intimate contact with the interior wall of casing 34 to provide a sealing and gripping arrangement between production tubing 30 and casing 34. To achieve this expansion, production tubing 30 includes launcher 52 and catcher 54. Initially disposed within launcher 52 is expander member 56.

It should be noted, however, by those skilled in the art that instead of installing production tubing string 30 in casing string 34 with expander member 56 already positioned within launcher 52, an expander member could alternatively be run in after production tubing string 30 has been installed within casing string 34. In this case, it may be necessary that the expander member have a smaller diameter running configuration such that it may be run in production tubing string 30 and through expandable production packer 46 prior to expansion and a larger diameter expansion configuration suitable for expanding expandable production packer 46 as described below.

Figure 2:
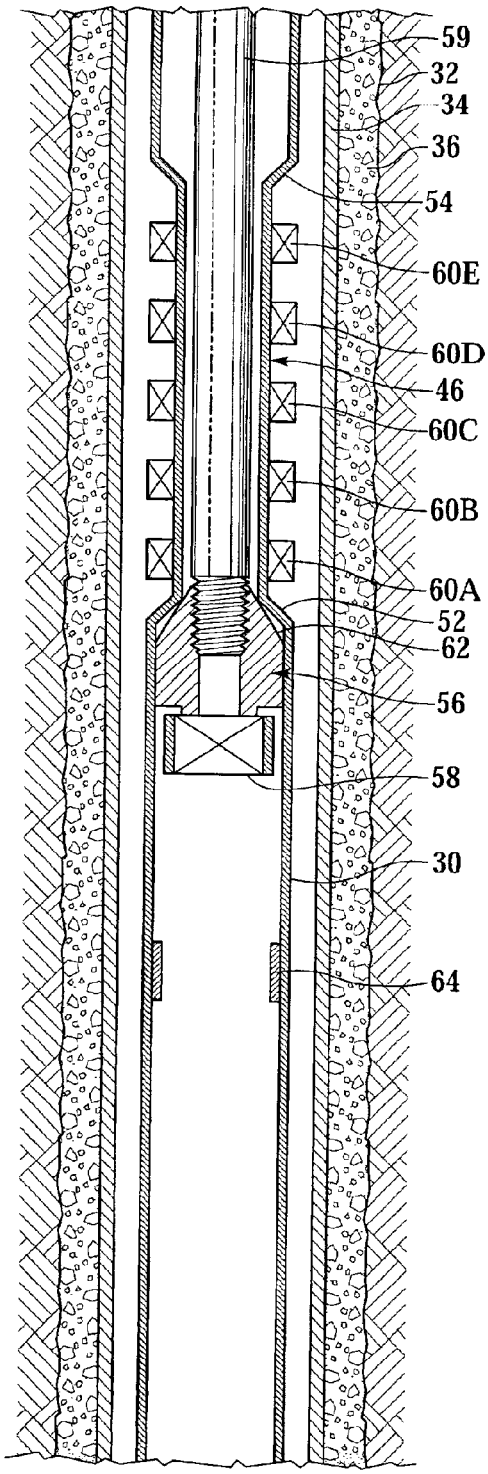
FIG. 2 is a half sectional view of an expandable production packer according to the present invention that is positioned within a casing string.
Figure 3:
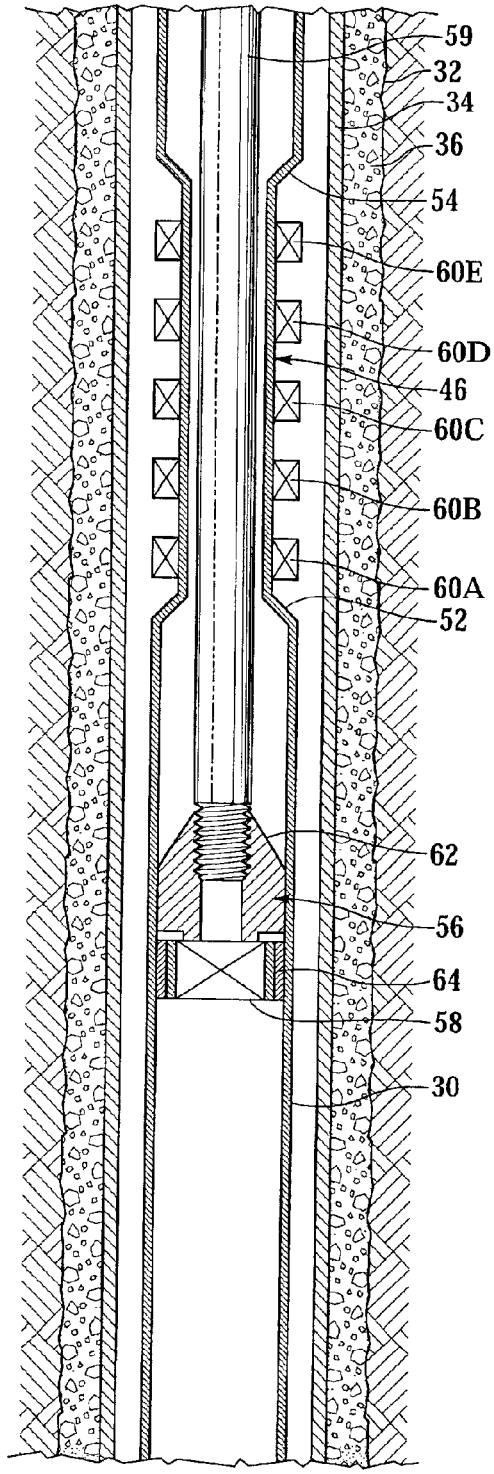
FIG. 3 is a half sectional view of an expandable production packer according to the present invention that is positioned within a casing string after installation of a plug.
Figure 4:
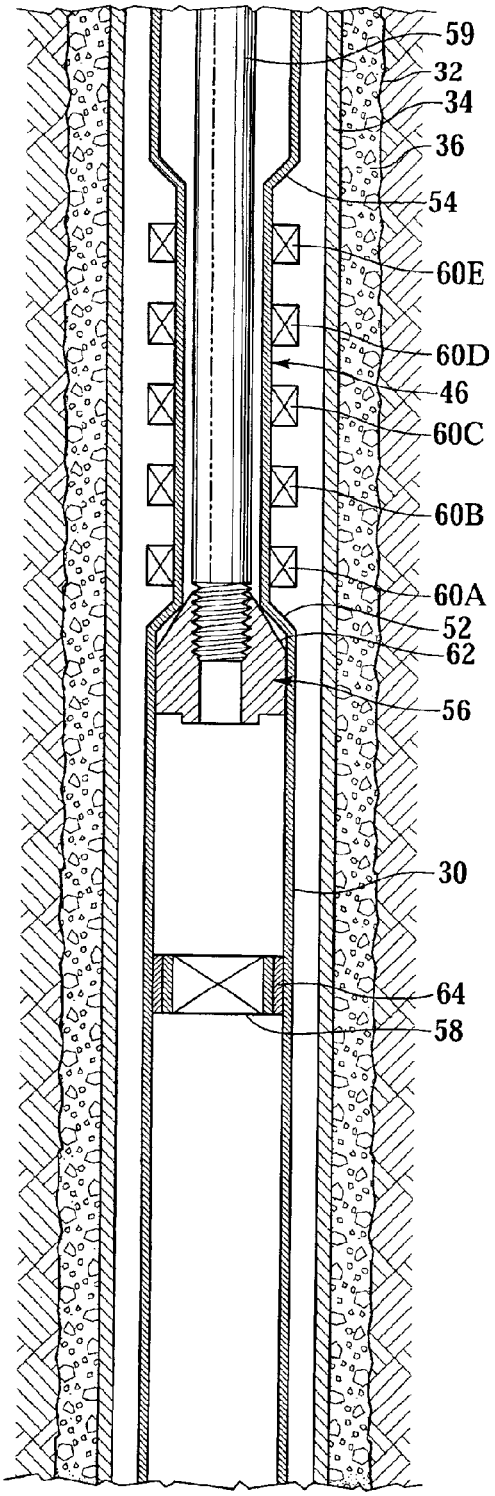
FIG. 4 is a half sectional view of an expandable production packer according to the present invention that is positioned within a casing string prior to expansion.

In the illustrated embodiment, expander member 56 has a tapered cone section 62 which includes a receiver portion that is coupled to the lower end of coiled tubing string 59. Initially, expander member 56 is coupled within launcher 52 by a shear pin (not pictured) or other suitable device that holds expander member 56 within launcher 52 but allows the release of expander member 56 as required. Also initially, plug 58 may be attached to the lower end of expander member 56, as best seen in FIG. 2. Once coiled tubing string 59 is coupled to expander member 56, a longitudinal force may be applied to expander member 56 to release expander member 56 from attachment with launcher 52. Thereafter, coiled tubing string 59, together with expander member 56 and plug 58 may be lowered downhole until plug 58 is located within landing nipple 64, as best seen in FIG. 3. Plug 58 is then released from expander member 56 and coiled tubing string 59, together with expander member 56 is raised uphole until expander member 56 is within launcher 52, as best seen in FIG. 4.

Figure 5:
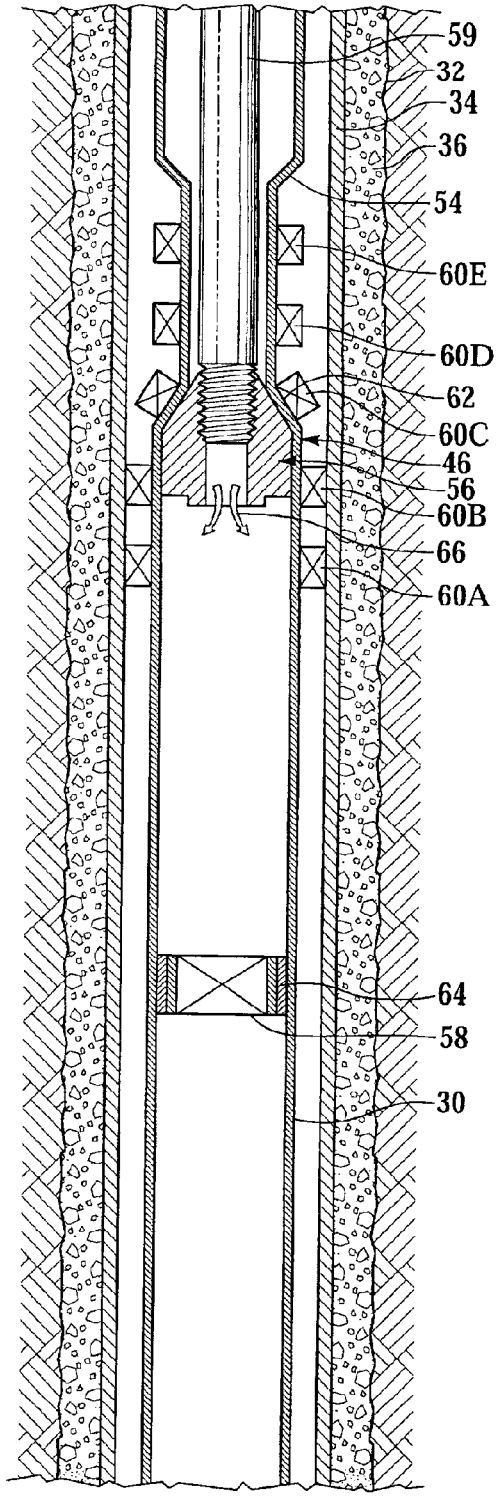
FIG. 5 is a half sectional view of an expandable production packer according to the present invention that is positioned within a casing string during expansion.

The diameter of the section of production tubing string 30 within expandable production packer 46 may now be increased by moving expander member 56 longitudinally through expandable production packer 46 from launcher 52 to catcher 54. As best seen in FIG. 5, a fluid is pumped down coiled tubing string 59 into the portion of production tubing string 30 between plug 58 and the lower end of expander member 56, as indicated by arrows 66. The fluid pressure urges expander member 56 upwardly such that tapered cone section 62 of expander member 56 contacts the interior wall of expandable production packer 46. As the fluid pressure increases, tapered cone section 62 applies a radially outward force to the wall of expandable production packer 46. When this force is sufficient to plastically deform expandable production packer 46, expander member 56 begins to travel longitudinally within expandable production packer 46.

As the upward movement of expander member 56 progresses, expandable production packer 46 substantially uniformly expands from its original diameter to a diameter similar to the diameter of expander member 56. As this expansion occurs, seal elements 60A–60E progressively expand into intimate contact with casing 34. Once seal elements 60A–60E are expanded, a fluid seal is created between production tubing 30 and casing 34. In addition, seal elements 60A–60E anchor production tubing 34 within casing 34. Seal elements 60A–60E may be constructed from a polymeric material such as rubber or other non-metallic materials or may be constructed from a metal such as lead or other suitable material that can expand radially when the production tubing about which it is attached is expanded and that can provide a suitable fluid seal and gripping force against the interior of casing 34. In addition, it should be understood by those skilled in the art that even though FIGS. 2–5 have depicted five seal elements 60A–60E attached to a section of production tubing 30 to form production packer 46, other numbers of seal elements both greater than and less than five could alternatively be used without departing from the principles of the present invention. In fact, a significant advantage of the production packers of the present invention is that numerous independent seal elements may be placed along one or more sections of the production tubing string which not only improves the reliability of the seal between the production tubing and the well casing but also improves the anchoring capability as the anchoring force is spread across a large area.

In addition, as seal elements 60A–60E provide both sealing and anchoring capabilities, the slips typically associated with production packers are not required, which, among other things, significantly reduces the complexity and cost of expandable production packers 46 of the present invention versus conventional production packers. If additional anchoring capability is desired with expandable production packers 46, however, the outer surface of the section of tubing string 30 of expandable production packer 46 may be serrated to increase the friction between expandable production packer 46 and the inner surface of casing 34.

It should be noted by those skilled in the art that the force necessary to plastically deform expandable production packer 46 is dependant upon a variety of factors including the ramp angle of tapered cone section 62, the amount of the desired expansion of expandable production packer 46, the material of expandable production packer 46 and the like. Since only a short section of expandable production packer 46 is being expanded at any one time, however, the fluid pumped through coiled tubing string 59 typically provides sufficient upward force to expander member 56 to expand that section of expandable production packer 46. This force may be controlled by adjusting the flow rate and pressure at which the fluid is delivered through coiled tubing string 59.

The upward force of expander member 56 may be enhanced by pulling on expander member 56, which may be accomplished by placing coiled tubing string 59 in tension. In fact, longitudinal movement of expander member 56 may be achieved completely mechanically by pulling expander member 56 through expandable production packer 46 by placing coiled tubing string 59 in sufficient tension. In this case, since no fluids are used to upwardly urge expander member 56, no plug 58 below catcher 52 is necessary. In the illustrated embodiment, once the expansion process is complete, coiled tubing string 59, expander member 56 and plug 58 may be retrieved to the surface. For example, expander member 56 may be returned to its runing configuration such that expander member 56 may travel back through expandable production packer 46 and be coupled to plug 58 prior to retrieval to the surface. Alternatively, coiled tubing string 59 and expander member 56 may be retrieved to the surface together and, thereafter, plug 58 may be retrieved by wireline or other suitable techniques.

It should be apparent to those skilled in the art that the use of direction terms such as above, below, upper, lower, upward, downward and the like are used in relation to the illustrated embodiments as they are depicted in the figures, the upward direction being toward the top of the corresponding figure and the downward being toward the bottom of the corresponding figure. Accordingly, it should be noted that the expandable production packer of the present invention and the methods for setting the expandable production packer of the present invention are not limited to the vertical orientation as they are equally well suited for use in inclined, deviated and horizontal wellbores.

Figure 6:
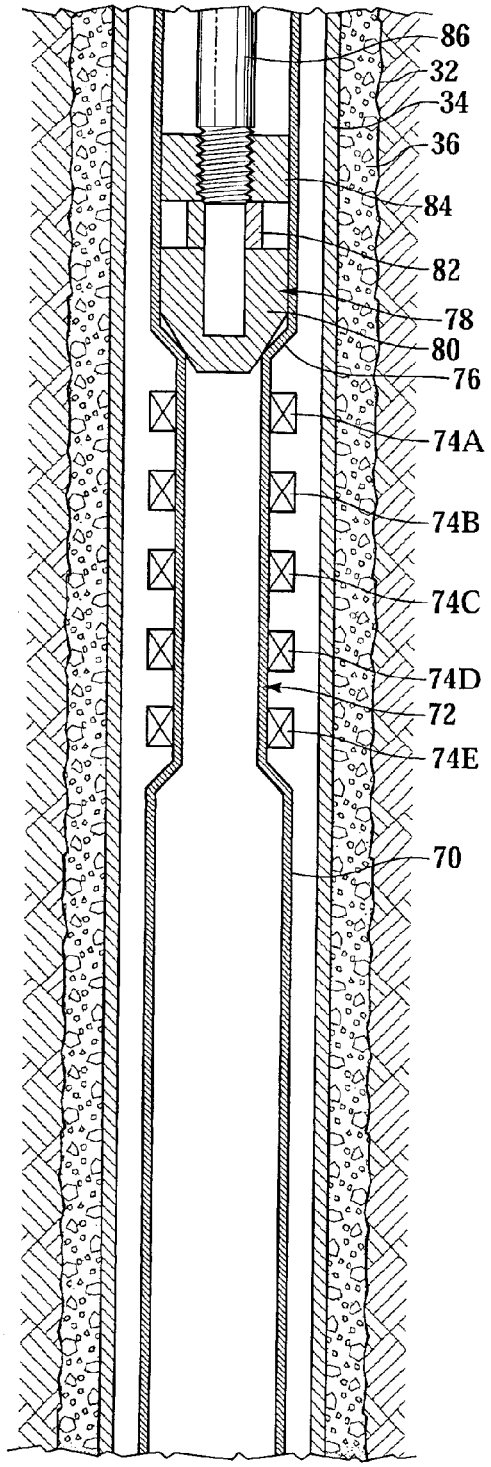
FIG. 6 is a half sectional view of an expandable production packer according to the present invention that is positioned within a casing string prior to expansion.
Figure 7:
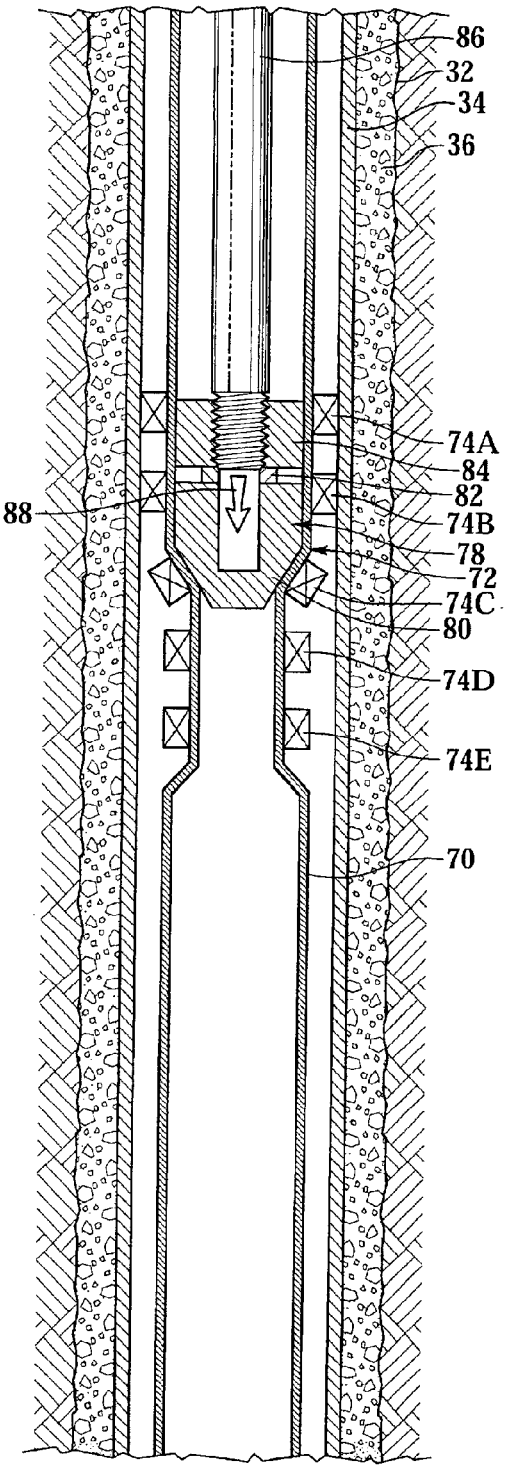
FIG. 7 is a half sectional view of an expandable production packer according to the present invention that is positioned within a casing string during expansion.

While FIGS. 1–5 have depicted the expansion of expandable production packer 46 as progressing from a downhole location to an uphole location, the expansion could alternatively progress from an uphole location to a downhole location, as best seen in FIGS. 6 and 7. Specifically, production tubing string 70 is disposed within wellbore 32 having casing string 34 cemented therein with cement 36. Disposed within production tubing string 70 is expandable production packer 72 including a plurality of seal elements 74A–74E position around a section of production tubing string 70. Above expandable production packer 72 is a launcher 76 into which an expander member 78 is placed. Expander member 78 includes a tapered cone section 80, a piston 82 and an anchor section 84. Anchor section 84 includes a receiver portion that is coupled to the lower end of coiled tubing string 86.

In operation, a downward force is placed on expander member 78 by applying the weight of coiled tubing string 86 on expander member 78. This downward force operates to stroke piston 82 to its compressed position, as best seen in FIG. 7. Once piston 82 completes its downward stroke, fluid is pumped down coiled tubing string 86 which sets anchor section 84 creating a friction grip between anchor section 84 and the interior of expandable production packer 72 which prevents upward movement of anchor section 84. More fluid is then pumped down coiled tubing string 86, as indicated by arrow 88, which urges tapered cone section 80 downwardly such that tapered cone section 80 places a radially outward force against the wall of expandable production packer 72 causing expandable production packer 72 to plastically deform creating a sealing and gripping connection between production tubing 70 and casing 34 with seal elements 74A–74E. This process continues in a step wise fashion wherein each stroke of expander member 78 expands a section of expandable production packer 72. After expandable production packer 72 has been expanded and expander member 78 has been returned to its running configuration, coiled tubing string 86 and expander member 78 may be retrieved to the surface.

Figure 8A:
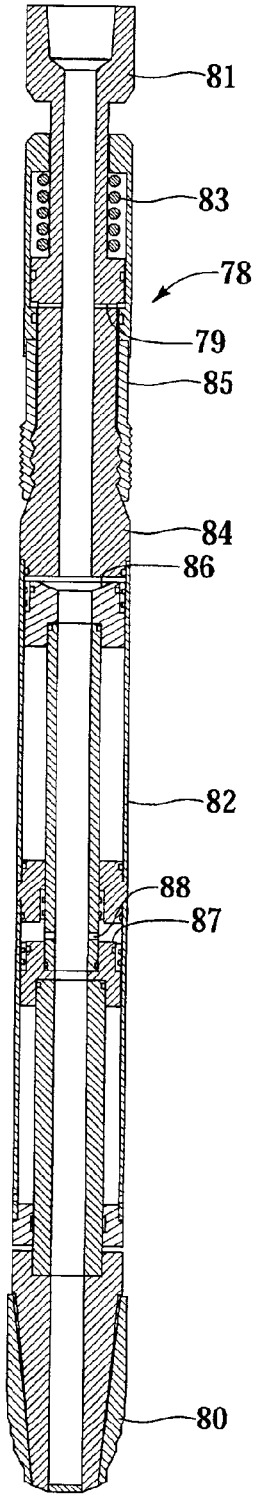
FIGS. 8A–8B are a half sectional views of an expander member for use in expanding the expandable production packer according to the present invention in its contacted and expanded positions, respectively.
Figure 8B:
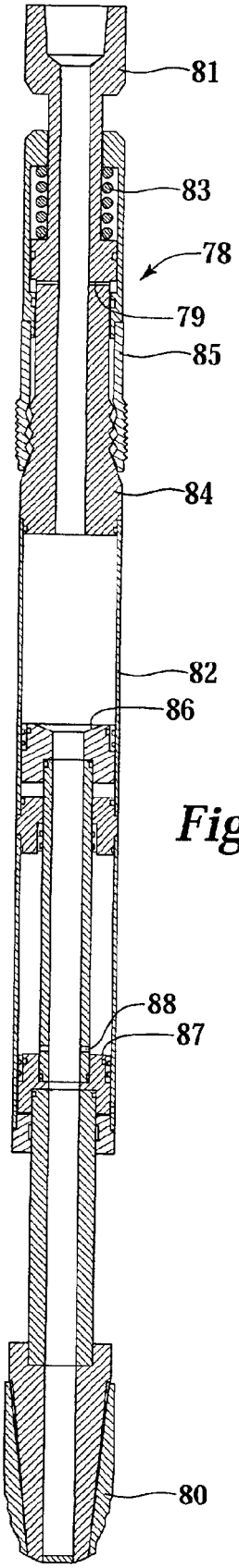
Figure 9:
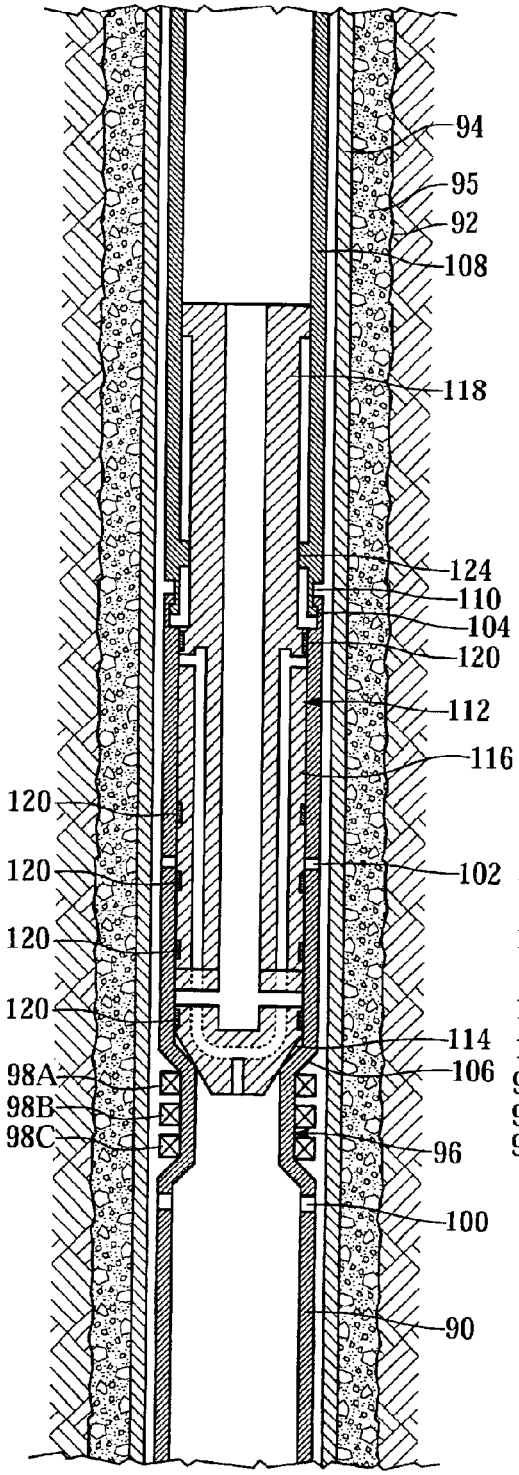
FIG. 9 is a half sectional view of an expandable production packer according to the present invention that is positioned within a casing string prior to expansion.

Referring now to FIGS. 8A–8B, therein are depicted more detailed views of expander member 78 in its expansion configuration and in its fully contracted and fully extended positions, respectively. Expander member 78 includes a tapered cone section 80, a piston 82 and an anchor section 84. Anchor section 84 includes a receiver portion 81 that may be coupled to the lower end of coiled tubing string 86 (not pictured). Anchor section 84 includes fluid ports 79, coiled spring 83 and slips 85 that cooperate together such that when a fluid pressure is applied within expander member 78 and into fluid ports 79, coiled spring 83 is compressed causing slips 85 to outwardly radially expand and grip the interior of expandable production packer 72 (not pictured). In addition, the fluid pressure acts on piston 82 on surface 86 and surface 87, via fluid ports 88, such that the force of the fluid pressure is multiplied. This force acting on piston 82 causes piston 82, along with tapered cone section 80, to be downwardly urged toward the position depicted in FIG. 8B. Once expander member 78 has completed its stroke and expanded a length of expandable production packer 72 (not pictured), the fluid pressure in expander member 78 is allowed to bleed off such that expander member 78 may be collapsed back to the configuration depicted in FIG. 8A and another stoke of expander member 78 may begin.

Referring now to FIGS. 9–12, therein is depicted another embodiment of a method for creating a fluid seal between production tubing and casing with an expandable production packer and treating a wellbore. Production tubing string 90 is disposed within wellbore 92 having a casing string 94 that is cemented within wellbore 92 with cement 96. Tubing string 90 includes expandable production packer 96 having seal elements 98A–98C. Tubing string 90 also includes treatment fluid ports 100 that are positioned downhole of expandable production packer 96, return fluid ports 102 that are positioned uphole of expandable production packer 96, a latch member 104 and a launcher 106. A work string 108 having a latch member 110 is coupled to tubing string 90 at latch member 104. Disposed within tubing string 90 and work string 108 is an expander member 112. Expander member 112 includes a tapered cone section 114, a cross-over section 116 and a piston section 118. Disposed between expander member 112 and tubing string 90 is a plurality of seals 120 carried on expander member 112 to provide fluid sealing therebetween.

Figure 10:
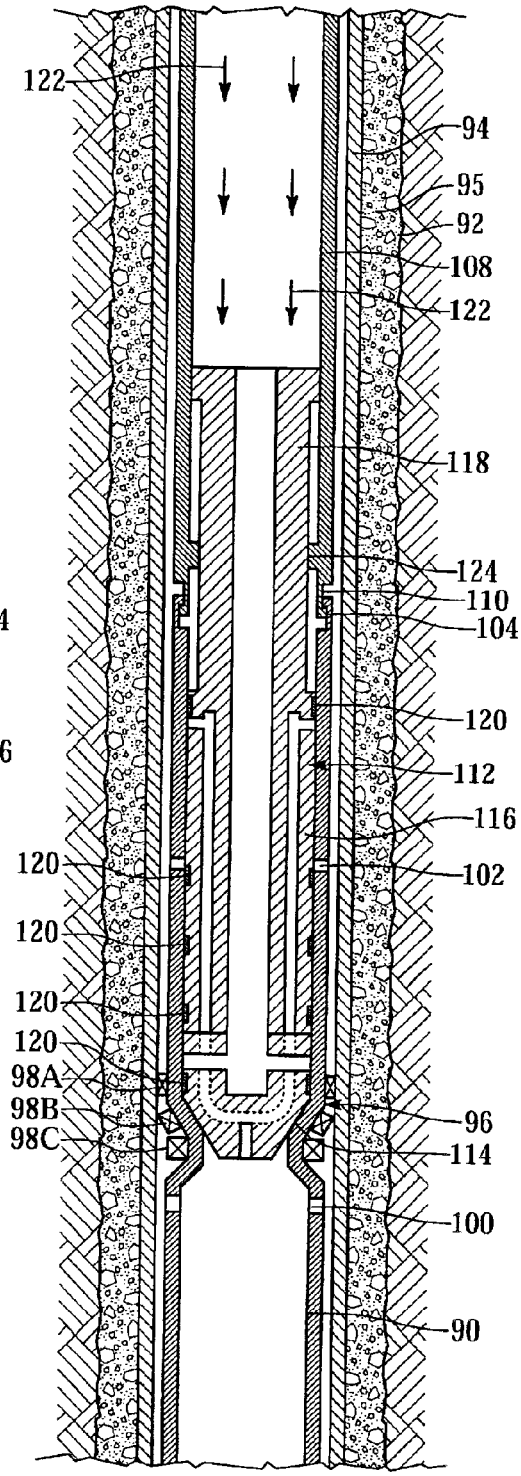
FIG. 10 is a half sectional view of an expandable production packer according to the present invention that is positioned within a casing string during expansion.
Figure 11:
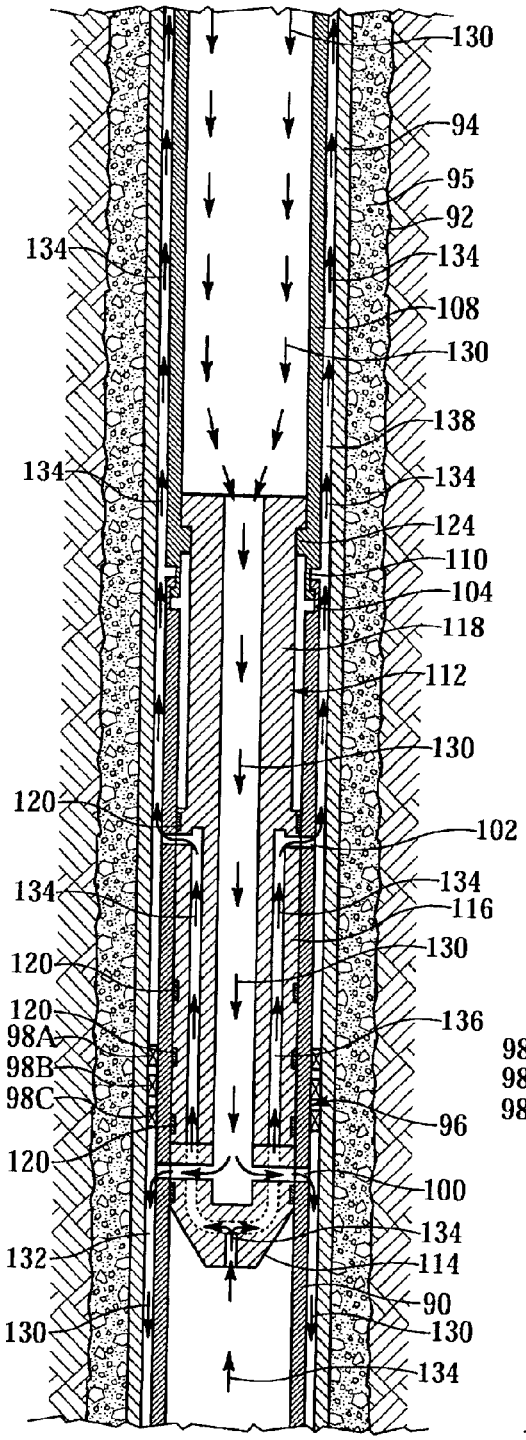
FIG. 11 is a half sectional view of an expandable production packer according to the present invention that is positioned within a casing string after expansion and during a well treatment process.

In operation, once tubing string 90 is properly positioned within casing 94 with expander member 112 therein, a fluid is pumped down work string 108 as indicated by arrows 122. As best seen in FIG. 10, the fluid pressure urges tapered cone section 114 downwardly placing a radially outward force against the wall of expandable production packer 96 causing expandable production packer 96 to plastically deform creating a sealing and gripping connection between tubing string 90 and casing 94 with seal elements 98A–98C. This process continues until piston section 118 reaches it full travel against shoulder 124, as best seen in FIG. 11.

At this point, seal elements 98A–98C of expandable production packer 96 provide a seal between production tubing 90 and casing 94. Also, cross-over section 116 traverses expandable production packer 96 with portions of cross-over assembly 154 on either side of packer 96. As illustrated, when the treatment operation is a frac pack, the objective is to enhance the permeability of formation 14 (see FIG. 1) by delivering a fluid slurry containing proppants at a high flow rate and in a large volume above the fracture gradient of the formation such that fractures may be formed within the formation and held open by the proppants. In addition, a frac pack also has the objective of preventing the production of fines by packing the annulus between sand control screens 38, 40, 42 (see FIG. 1) and casing 34 with the proppants. To help achieve these results, a valve at the surface is initially in the closed position to prevent the flow of return fluids.

The fluid slurry containing proppants is then pumped down work string 108 and expander member 112 as indicated by arrows 130. In the illustrated embodiment, the fluid slurry containing proppants exits expander member 112 and enters annulus 132 between casing 94 and production tubing 90, via treatment fluid ports 100. As the fluid slurry containing proppants is being delivered at a high flowrate and in a large volume above the fracture gradient of formation 14 and as no returns are initially taken, the fluid slurry fractures formation 14. It should be noted that as the frac pack operation progresses some of the proppants in the fluid slurry screens out in annulus 132, thereby packing annulus 132 around sand control screens 38, 40, 42. This packing process may be enhanced by reducing the flow rate of the fluid slurry toward the end of the treatment process and opening the surface valve to allow some returns to flow to the surface.

Specifically, when the surface valve is opened, the liquid carrier of the fluid slurry containing proppants is allowed the travel through sand control screens 38, 40, 42 while the proppants are disallowed from traveling through sand control screens 38, 40, 42. Accordingly, the proppants become tightly packed in annulus 132. The return fluids, as indicated by arrows 134, travel up tubing string 90 into expander member 112. Return fluids 134 then travel through a micro-annulus 136 within expander member 112 and return fluid ports 102 before entering annulus 138 between work string 108 and casing 94 for return to the surface. It should be noted by those skilled in the art that even though a frac pack operation has been described, expander member 112 is equally well-suited for use in other well treatment operations including fracture operations, gravel pack operations, cementing operations, chemical treatment operations and the like.

Figure 12:
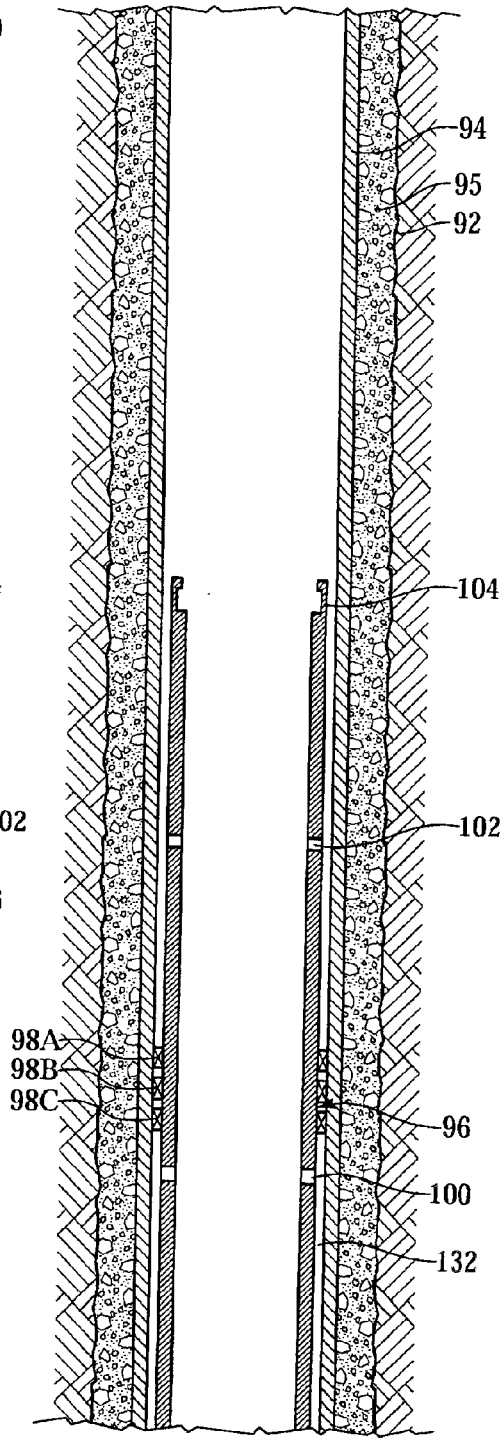
FIG. 12 is a half sectional view of an expandable production packer according to the present invention that is positioned within a casing string after completion of the well treatment process and retrieval of the work string.

After the process of creating the fluid seal between the casing and the production tubing as well as the process of well treatment is complete, work string 108 along with expander member 112 are retrieved to the surface, as best seen in FIG. 12. This is achieved by releasing latch member 104 of tubing string 90 from latch member 110 of work string 108. Thereafter, the rest of the production tubing string may be run downhole and attached to tubing string 90 at latch 104 or by other suitable means.

Figure 13:
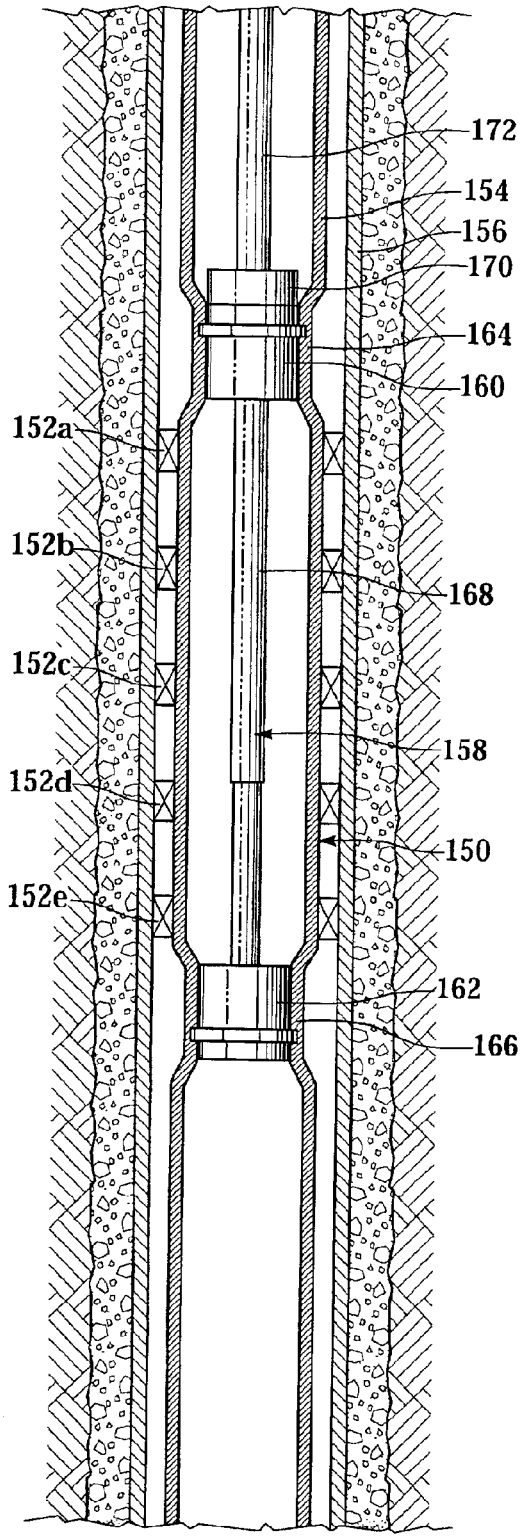
FIG. 13 is a half sectional view of an expandable production packer according to the present invention that is positioned within a casing string and having a release member positioned therein prior to the release operation.
Figure 14:
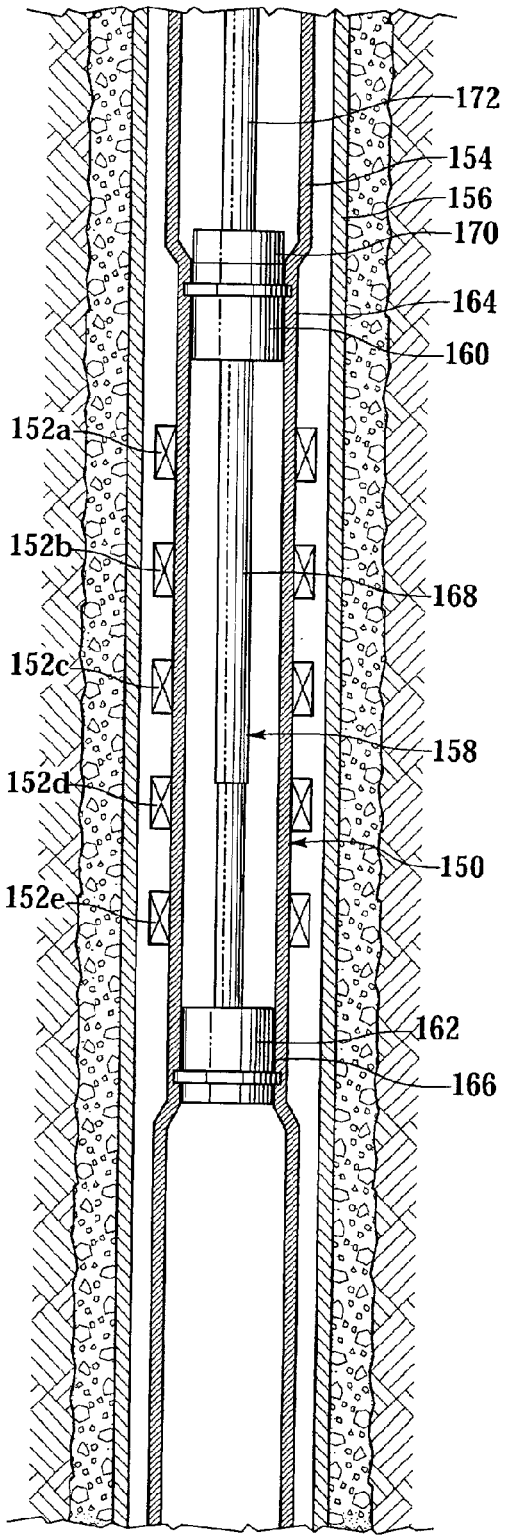
FIG. 14 is a half sectional view of an expandable production packer according to the present invention that has been released from a casing string using a release member.

With all the above described embodiments of the expandable production packer of the present invention, it may be necessary to remove an expandable production packer of the present invention once it has been installed. Accordingly, the present invention provides several methods of releasing an expandable production packer of the present invention for retrieval. Referring now to FIGS. 13–14, therein are depicted one method of releasing an expandable production packer that is designated 150. Expandable production packer 150 includes a plurality of seal elements 152A–152E that are positioned around an expandable section of tubing string 154 that has previously been expanded using a technique described herein or other suitable technique. As illustrated, seal elements 152A–152E are in intimate contact with the interior wall of casing 156 such that a sealing and gripping arrangement exists between production tubing 154 and casing If it becomes necessary to retrieve expandable production packer 150, the intimate contact of seal elements 152A–152E with the interior of casing string 156 must be released. This is achieved using release member 158. In the illustrated embodiment, release member 158 includes a pair of latching keys 160, 162 that respectively match and lock into latch profiles 164, 166 of tubing string 154. Release member 158 also includes a piston section 168 and a receiver portion 170 that is coupled to the lower end of coiled tubing string 172 and that provides for fluid communication between coiled tubing string 172 and piston section 168. Once release member 158 and coiled tubing string 172 are positioned as depicted in FIG. 13, an axially tensile force may be placed on expandable production packer 150 between latch profiles 164, Specifically, in the illustrated embodiment, a fluid is pumped downhole via coiled tubing string 172 and into piston section 168 placing expandable production packer 150 in tension between latch profiles 164, 166. As the pressure increases within piston section 168, the tensile force becomes sufficient to plastically deform expandable production packer 150 such that the diameter of expandable production packer 150 is reduced. Multiple factors work together to achieve this reduction.

For example, the tensile force placed on expandable production packer 150 causes elongation in the expandable section of tubing string 154 between latch profiles 164, 166.

This elongation results in a reduction in the diameter of this section of tubing 154 and accordingly a reduction in the diameter of seal elements 152A–152E. In addition, the diameter of seal elements 152A–152E is further reduced due to the elongations of seal elements 152A–152E themselves. Further, the difference in the diameter of tubing 154 between latch profiles 164, 166 and the diameter of tubing 154 at latch profiles 164, 166 cause a radially inward force to act on tubing 154 between latch profiles 164, 166 while the tensile force is being applied. Accordingly, under sufficient tensile force, the diameter of tubing 154 between latch profiles 164, 166 is reduced such that the intimate contact between seal elements 152A–152E and the interior of casing string 156 is released, as best seen in FIG. 14. Thereafter, tubing string 154 along with expandable production packer 150 can be retrieved to the surface.

It should be noted by those skilled in the art that the force necessary to plastically deform expandable production packer 150 and allow release thereof is dependant upon a variety of factors including the difference in the diameter of tubing 154 between latch profiles 164, 166 and the diameter of tubing 154 at latch profiles 164, 166, the amount of expansion originally achieved by expandable production packer 150, the material of expandable production packer 150 and the like. It should be noted that the tensile force may be controlled by adjusting the fluid pressure delivered through coiled tubing string 172. Additionally, it should be understood by those skilled in the art that even though FIG. 14 depicts the diameter of tubing 154 between latch profiles 164, 166 being reduced such that no contact between seal elements 152A–152E and the interior of casing string 156 remains, some contact between one or more of the seal elements 152A–152E and the interior of casing string 156 is acceptable as long as expandable production packer 150 can be retrieved to the surface.

Figure 15:
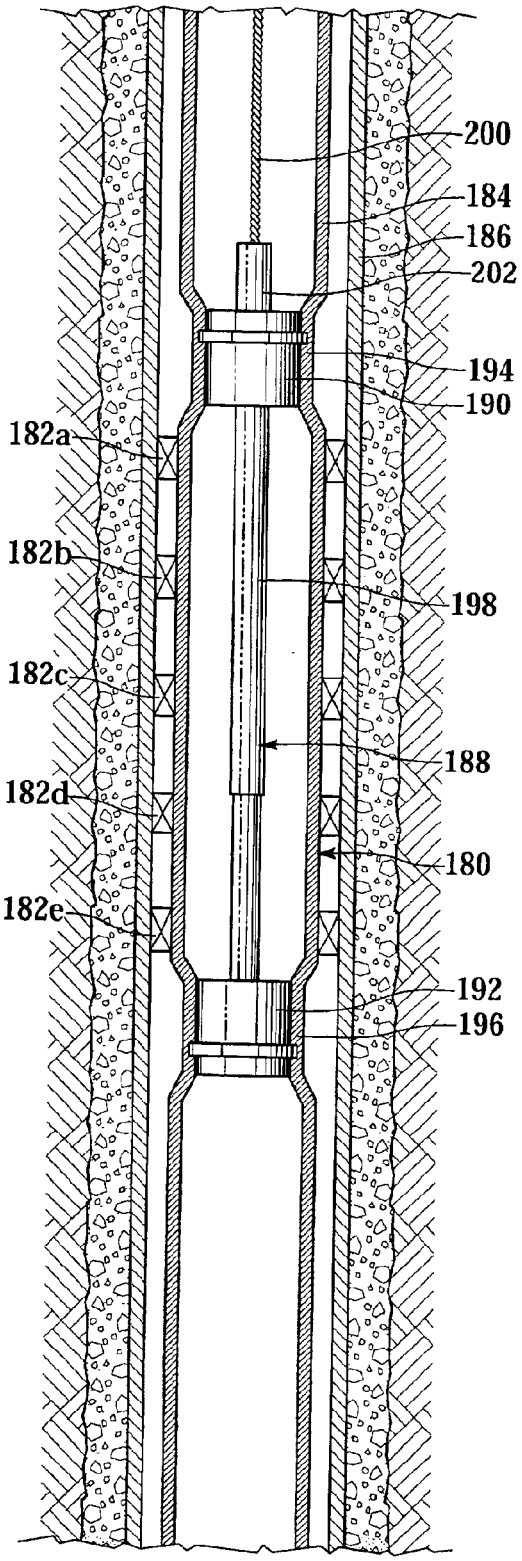
FIG. 15 is a half sectional view of an expandable production packer according to the present invention that is positioned within a casing string and having a release member positioned therein prior to the release operation.

Referring now to FIG. 15, therein is depicted another method of releasing an expandable production packer that is designated 180. Expandable production packer 180 includes a plurality of seal elements 182A–182E that are positioned around an expandable section of tubing string 184 that has previously been expanded using a technique described herein or other suitable technique. As illustrated, seal elements 182A–182E are in intimate contact with the interior wall of casing 186 such that a sealing and gripping arrangement exists between production tubing 184 and casing 186.

If it becomes necessary to retrieve expandable production packer 180, the intimate contact of seal elements 182A–182E with the interior of casing string 186 must be released. This is achieved using release member 188 that includes a pair of latching keys 190, 192 that respectively match and lock into latch profiles 194, 196 of tubing string 184. Release member 188 also includes a piston section 198. Release member 188 may be run downhole on a conveyance 200 such as a jointed tubing, a coiled tubing, a wireline, a slickline, an electric line or the like. Coupled between conveyance 200 and release member 188 is an operating assembly 202.

In one embodiment, conveyance 200 is a wireline and operating assembly 202 is a hydraulic pump. In this embodiment, the wireline may be used to stroke the hydraulic pump such that fluid is pumped into piston section 198, thereby placing an axially tensile force on expandable production packer 180 between latch profiles 194, 196 which elongates this section of tubing 184, as described herein, allowing for the release of expandable production packer 180.

In another embodiment, conveyance 200 is an electric line and operating assembly 202 is an electrical hydraulic pump. In this embodiment, the electricity provides the energy to operate the hydraulic pump such that fluid is pumped into piston section 198, thereby placing an axially tensile force on expandable production packer 180 between latch profiles 194, 196 which elongates this section of tubing 184, as described herein, allowing for the release of expandable production packer 180.

In yet another embodiment, conveyance 200 is an electric line and operating assembly 202 is a downhole power unit. In this embodiment, the electricity provides the energy to operate the downhole power unit to rotate a shaft that drives piston section 198, thereby placing an axially tensile force on expandable production packer 180 between latch profiles 194, 196 which elongates this section of tubing 184, as described herein, allowing for the release of expandable production packer 180.

In a further embodiment, conveyance 200 is an electric line and operating assembly 202 includes both a downhole power unit and a hydraulic pump. In this embodiment, the downhole power unit may be used to stroke the hydraulic pump such that fluid is pumped into piston section 198, thereby placing an axially tensile force on expandable production packer 180 between latch profiles 194, 196 which elongates this section of tubing 184, as described herein, allowing for the release of expandable production packer 180.

In all of these embodiments, once sufficient tensile force is generated and the diameter of tubing 184 between latch profiles 194, 196 is reduced, the intimate contact between seal elements 182A–182E and the interior of casing string 186 is released, such that tubing string 184 along with expandable production packer 180 can be retrieved to the surface.

Figure 16:
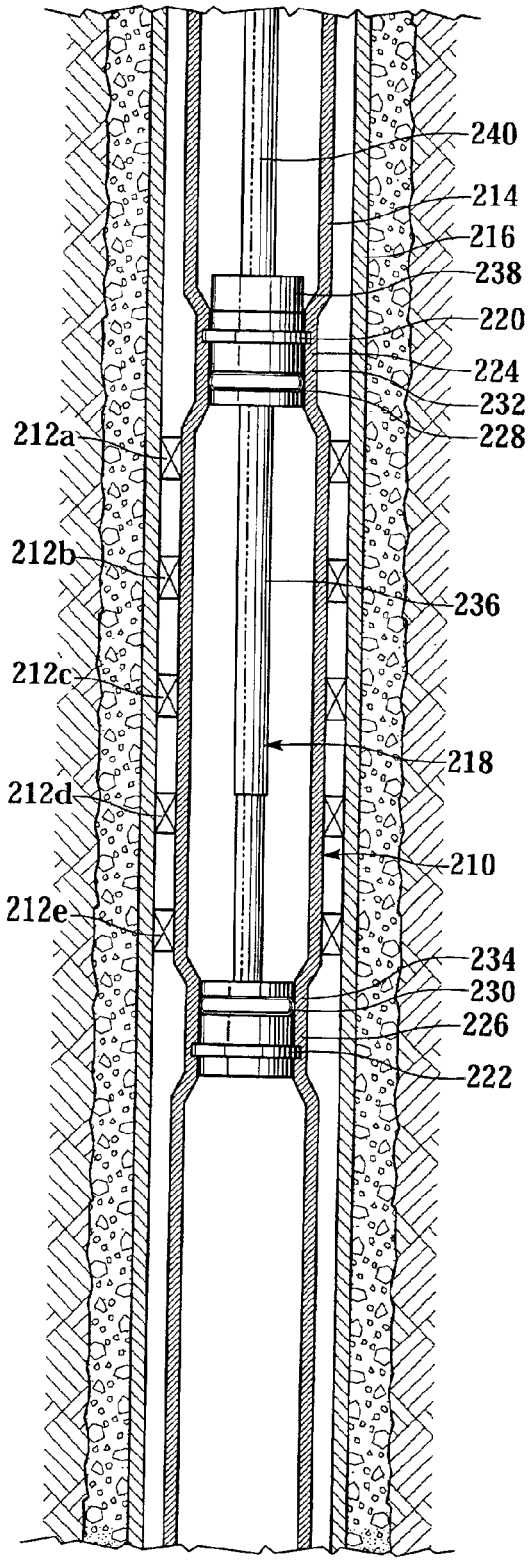
FIG. 16 is a half sectional view of an expandable production packer according to the present invention that is positioned within a casing string and having a release member positioned therein prior to the release operation.

Referring now to FIG. 16, therein is depicted another method of releasing an expandable production packer that is designated 210. Expandable production packer 210 includes a plurality of seal elements 212A–212E that are positioned around an expandable section of tubing string 214 that has previously been expanded using a technique described herein or other suitable technique. As illustrated, seal elements 212A–212E are in intimate contact with the interior wall of casing 216 such that a sealing and gripping arrangement exists between production tubing 214 and casing 216.

If it becomes necessary to retrieve expandable production packer 210, the intimate contact of seal elements 212A–212E with the interior of casing string 216 must be released. This is achieved using release member 218. In the illustrated embodiment, release member 218 includes a pair of latching keys 220, 222 that respectively match and lock into latch profiles 224, 226 of tubing string 214. Release member 218 also includes seal elements 228, 230 that respectively create a fluid seal against seal bores 232, 234. Release member 218 further includes a piston section 236 and a receiver portion 238 that is coupled to the lower end of coiled tubing string 240 and that provides for fluid communication between coiled tubing string 240 and piston section 236.

As described herein, once release member 218 and coiled tubing string 240 are positioned as depicted in FIG. 16, an axial force may be placed on expandable production packer 210 between latch profiles 224, 226 by pumping a fluid into piston section 236 via coiled tubing string 240. In this embodiment, not only does this tensile force cause elongation in the expandable section of tubing string 214, elongation of seal elements 212A–212E and a radially inward force based upon the difference in the diameter of tubing 214 between latch profiles 224, 226 and the diameter of tubing 214 at latch profiles 224, 226, this tensile force also create a collapse force surrounding expandable production packer 210.

Specifically, as expandable production packer 210 is elongated, the volume within expandable production packer 210 between seal elements 228, 230 also expands. This expansion causes a drop in the pressure of the fluids trapped in this volume creating a differential pressure across the wall of expandable production packer 210. This differential pressure creates a radially inwardly acting collapse force on expandable production packer 210, which aids in the diameter reduction of tubing 214 between latch profiles 224, 226 such that the intimate contact between seal elements 212A–212E and the interior of casing string 216 is released. Thereafter, tubing string 214 along with expandable production packer 210 can be retrieved to the surface.

It should be understood by those skilled in the art that release member 218 as described herein could alternatively be used as an expander member to set an expandable production packer of the present invention. Specifically, by reconfiguring piston section 236, fluid pressure delivered via coiled tubing string 240 could provide compression to the expandable section of tubing string 214 between latch profiles 224, 226. As this section of tubing 214 begins to shorten, the volume within expandable production packer 210 between seal elements 228, 230 is reduced. This reduction causes an increase in the pressure of the fluids trapped in this volume creating a differential pressure across the wall of expandable production packer 210. This differential pressure creates a radially outwardly acting expansion force on expandable production packer 210, which aids in the diameter expansion of tubing 214 between latch profiles 224, 226 such that intimate contact between seal elements 212A–212E and the interior of casing string 216 can be created.

Figure 17:
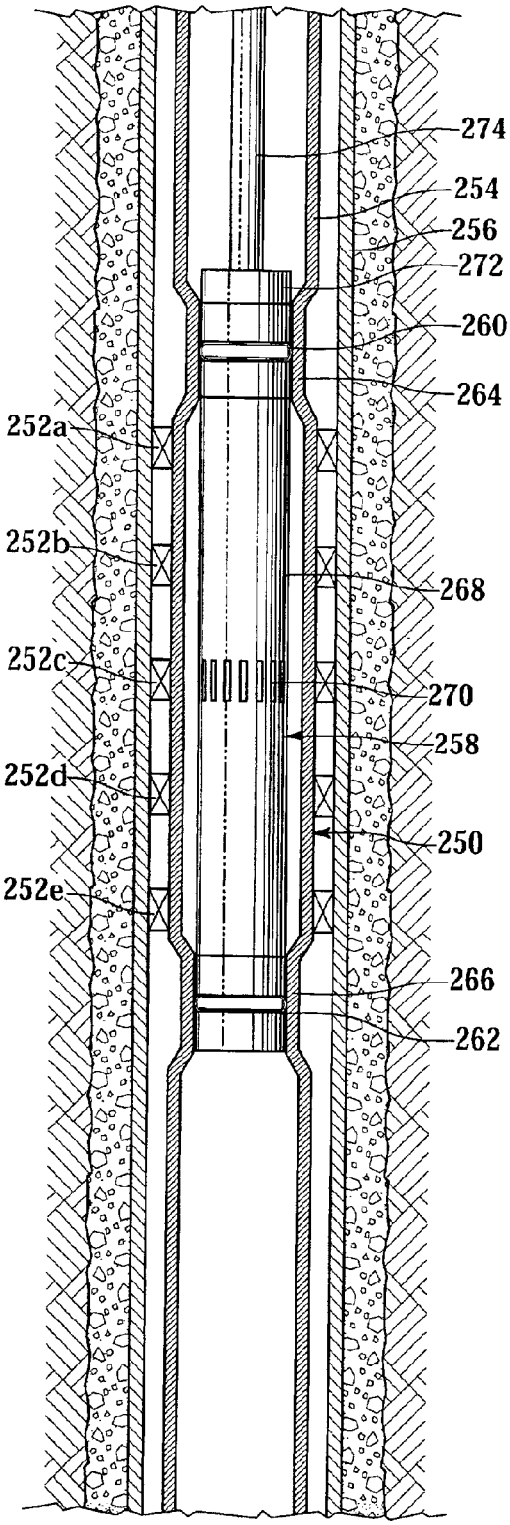
FIG. 17 is a half sectional view of an expandable production packer according to the present invention that is positioned within a casing string and having a release member positioned therein prior to the release operation.

Referring now to FIG. 17, therein is depicted another method of releasing an expandable production packer that is designated 250. Expandable production packer 250 includes a plurality of seal elements 252A–252E that are positioned around an expandable section of tubing string 254 that has previously been expanded using a technique described herein or other suitable technique. As illustrated, seal elements 252A–252E are in intimate contact with the interior wall of casing 256 such that a sealing and gripping arrangement exists between production tubing 254 and casing 256.

If it becomes necessary to retrieve expandable production packer 250, the intimate contact of seal elements 252A–252E with the interior of casing string 256 must be released. This is achieved using release member 258. In the illustrated embodiment, release member 258 includes a pair of seal elements 260, 262 that respectively create a fluid seal against seal bores 264, 266. Release member 258 further includes a mandrel section 268 having a plurality of ports 270 and a receiver portion 272 that is coupled to the lower end of coiled tubing string 274 and that provides for fluid communication between coiled tubing string 274 and mandrel section 268.

Once release member 258 and coiled tubing string 274 are positioned as depicted in FIG. 17, a collapse force may be created surrounding expandable production packer 250 by depressurizing the volume within expandable production packer 250. Specifically, once fluid communication is established between this volume and the interior of coiled tubing string 274 by, for example, operating a sleeve valve to open ports 270, the pressure of the fluids within this volume may be reduced by, for example, having a relatively light fluid within coiled tubing string 274, which creates a differential pressure across the wall of expandable production packer 250. This differential pressure creates a radially inwardly acting collapse force on expandable production packer 250, such that the intimate contact between seal elements 252A–252E and the interior of casing string 256 is released. Thereafter, tubing string 254 along with expandable production packer 250 can be retrieved to the surface.

Figure 18:
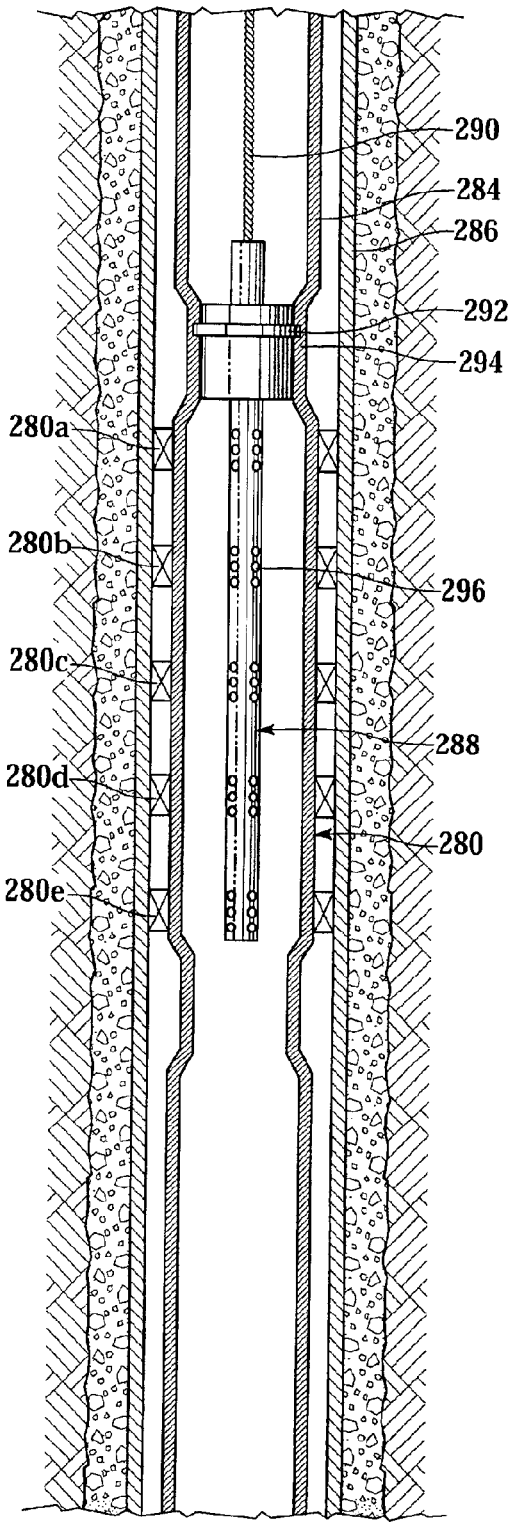
FIG. 18 is a half sectional view of an expandable production packer according to the present invention that is positioned within a casing string and having a radial cutting tool positioned.
Figure 19:
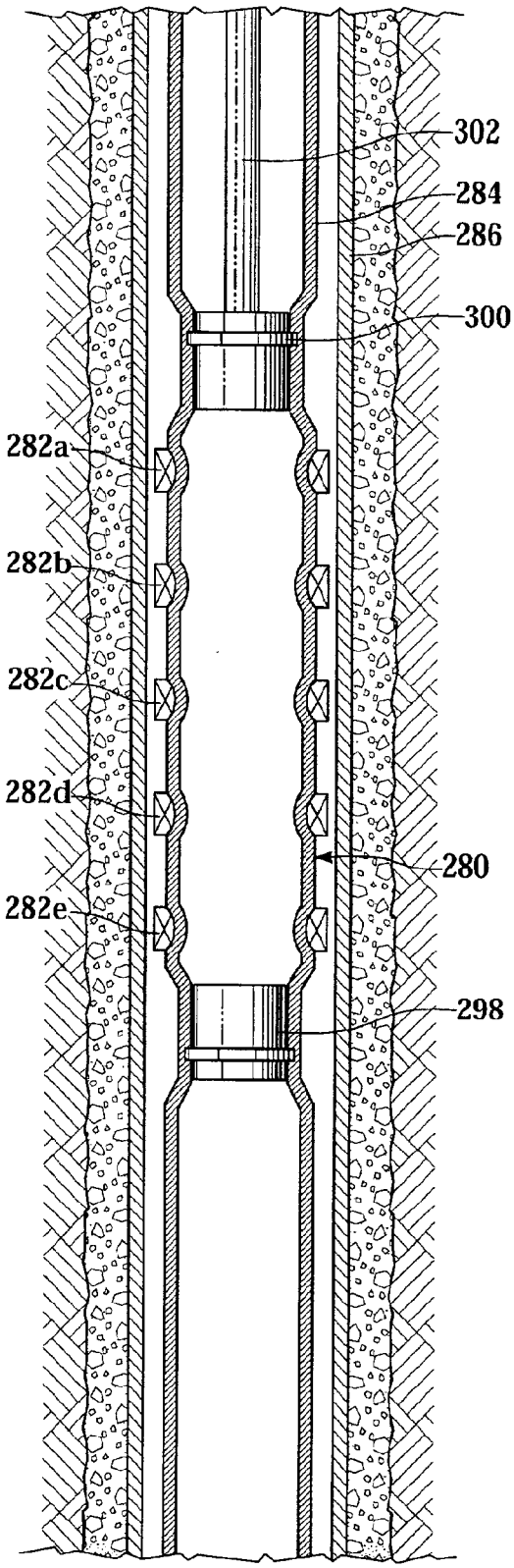
FIG. 19 is a half sectional view of an expandable production packer according to the present invention that has been released from a casing string.

Referring now to FIGS. 18–19, therein are depicted another method of releasing an expandable production packer that is designated 280. Expandable production packer 280 includes a plurality of seal elements 282A–282E that are positioned around an expandable section of tubing string 284 that has previously been expanded using a technique described herein or other suitable technique. As illustrated, seal elements 282A–282E are in intimate contact with the interior wall of casing 286 such that a sealing and gripping arrangement exists between production tubing 284 and casing 286.

If it becomes necessary to retrieve expandable production packer 280, the intimate contact of seal elements 282A–282E with the interior of casing string 286 must be released. This is achieved by weakening the sections of tubing 284 behind seal elements 282A–282E using a radial cutting tool 288. In the illustrated embodiment, radial cutting tool 288 may be run downhole on an electric line 290 until a latching key 292 of radial cutting tool 288 locks into latch profile 294. Radial cutting tool 288 may use any one of several cutting techniques that are well known in the art including, but not limited to, chemical cutting, thermal cutting, mechanical cutting, explosive cutting or the like.

For example, radial cutting tool 288 may be a chemical cutter such as that described in U.S. Pat. No. 5,575,331, which is hereby incorporated by reference. Once in place, radial cutting tool 288 is operated to cut a series of notches or grooves into the interior wall of expandable production packer 280 behind seal elements 282A–282E. In the case of using the chemical cutter, a dispersed jet of cutting fluid is released through cutting ports 296. In the illustrated embodiment, cutting ports 296 are circumferentially positioned at 90 degree intervals around radial cutting tool 288 such that the portion of tubing 284 behind seal elements 282A–282E will have a series of axially oriented grooves or notches that are circumferentially positioned at 90 degree intervals relative to one another. It should be noted by those skilled in the art, however, that other cutting configurations may alternatively be used without departing from the principles of the present invention.

The chemical cutter is fired by an electrical signal carried via electric line 290. The depth of cut made by the chemical cutter is predetermined and is controlled by the composition of chemicals loaded into the chemical cutter and the geometry of cutting ports 296. Preferably, the chemical cutter is set to make a cut that partially penetrates the wall of expandable production packer 280 behind seal elements 282A–282E.

Once the grooves or notches have been cut into expandable production packer 280 behind seal elements 282A–282E by radially cutting tool 288, radial cutting tool 288 may be retrieved to the surface. Thereafter, as best seen in FIG. 19, a plug 298 may be set below expandable production packer 280 and a sealing member 300 coupled to the lower end of a coiled tubing string 302 may be set above expandable production packer 280. A collapse force may then be created surrounding expandable production packer 280 by depressurizing the volume within expandable production packer 280. Specifically, once fluid communication is established between this volume and the interior of coiled tubing string 302 by, for example, operating a valve within seal member 300, the pressure of the fluids within this volume may be reduced by, for example, having a relatively light fluid within coiled tubing string 302, which creates a differential pressure across the wall of expandable production packer 280. This differential pressure creates a radially inwardly acting collapse force on expandable production packer 280. As the sections of tubing 284 behind seal elements 282A–282E have been weakened as described herein, the collapse force acts preferentially on these sections, such that the intimate contact between seal elements 282A–282E and the interior of casing string 286 is released. Thereafter, tubing string 284 along with expandable production packer 280 can be retrieved to the surface.

Even though FIGS. 18–19 have been described with reference to weakening the sections of tubing 284 behind seal elements 282A–282E using a radial cutting tool 288 to create notches or grooves in tubing 284, it should be understood by those skilled in the art the such a radial cutting tool could alternatively be used to completely cut through the sections of tubing 284 behind seal elements 282A–282E. In this case, the collapse force that is created surrounding expandable production packer 280 by depressurizing the volume within expandable production packer 280 may be reduced or that step may be eliminated while still allowing release of seal elements 282A–282E from the interior of casing string 286.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A single trip method for completing a well that traverses a subterranean formation, the method comprising the steps of:

disposing a releasable production packer within a well casing, the releasable production packer including at least one seal element positioned around a section of a production tubing;

setting the releasable production packer downhole by radially expanding the section of the production tubing to create a seal between the production tubing and the well casing; and pumping a treatment fluid through a cross-over assembly into an annulus between the production tubing and the well casing downhole of the releasable production packer.

2. The method as recited in claim 1 wherein the step of setting the releasable production packer downhole further comprises expanding the section of the production tubing from an uphole location to a downhole location.

3. The method as recited in claim 1 wherein the step of setting the releasable production packer downhole further comprises placing an expander member within the production tubing and pressurizing at least a portion of the production tubing to urge the expander member to travel longitudinally within the releasable production packer.

4. The method as recited in claim 3 further comprising retrieving the expander member from the production tubing by decoupling a work string from the production tubing.

5. The method as recited in claim 3 further comprising the step of aligning the cross-over assembly with fluid treatment ports in the production tubing downhole of the releasable production packer and return ports in the production tubing uphole of the releasable production packer.

6. The method as recited in claim 1 wherein the step of pumping a treatment fluid through a cross-over assembly into an annulus between the releasable production tubing and the well casing downhole of the releasable production packer further comprises fracturing the formation.

7. The method as recited in claim 1 wherein the step of pumping a treatment fluid through a cross-over assembly into an annulus between the releasable production tubing and the well casing downhole of the releasable production packer further comprises performing a gravel pack operation.

8. The method as recited in claim 1 wherein the step of pumping a treatment fluid through a cross-over assembly into an annulus between the production tubing and the well caging downhole of the releasable production packer further comprises performing a frac pack operation.

9. A single trip system for completing a well that traverses a subterranean formation, the system comprising:

a releasable production packer positioned within a well casing, the releasable production packer including at least one seal element positioned around a section of a production tubing;

an expander member positioned within the production tubing that travels longitudinally through the releasable production packer to expand the section of the production tubing downhole, thereby creating the seal between the production tubing and the well casing; and a cross-over assembly operably associated with the expander member through which a treatment fluid is delivered into an annulus between the production tubing and the well casing downhole of the releasable production packer.

10. The system as recited in claim 9 wherein the expander member travels longitudinally within the releasable production packer from an uphole location to a downhole location.

11. The system as recited in claim 9 wherein the expander member is urged to travel longitudinally within the releasable production packer by pressurizing at least a portion of the production tubing.

12. The system as recited in claim 9 further comprising a work string that is releasable couplable with the production tubing that retrieves the expander member from the production tubing after decoupling from the production tubing.

13. The system as recited in claim 9 wherein first ports of the cross-over assembly are aligned with fluid treatment ports in the production tubing downhole of the releasable production packer and second ports of the cross-over assembly are aligned with return ports in the production tubing uphole of the releasable production packer.

14. The system as recited in claim 9 wherein the treatment fluid is a fracture fluid.

15. The system as recited in claim 9 wherein the treatment fluid is a gravel pack slurry.

16. The system as recited in claim 9 wherein the treatment fluid is a frac pack slurry.

* * * * *